US010034502B2

(12) United States Patent
Elliott

(10) Patent No.: US 10,034,502 B2
(45) Date of Patent: Jul. 31, 2018

(54) HAND WEAR RETENTION SYSTEM

(71) Applicant: Vicki Elliott, Kanata (CA)

(72) Inventor: Vicki Elliott, Kanata (CA)

( * ) Notice: Subject to any disclaimer, the term of this patent is extended or adjusted under 35 U.S.C. 154(b) by 0 days.

(21) Appl. No.: 14/592,454

(22) Filed: Jan. 8, 2015

(65) Prior Publication Data

US 2015/0189931 A1 Jul. 9, 2015

(51) Int. Cl.

| | |
|---|---|
| ***A41D 19/00*** | (2006.01) |
| ***A44B 99/00*** | (2010.01) |
| ***A41F 19/00*** | (2006.01) |
| ***A41D 19/01*** | (2006.01) |

(52) U.S. Cl.

CPC ..... *A41D 19/0041* (2013.01); *Y10T 24/1394* (2015.01); *Y10T 24/1397* (2015.01)

(58) Field of Classification Search

CPC ..... A41D 19/0041; Y10T 24/1397; Y10T 24/1394; Y10T 24/1368; Y10T 24/2708

See application file for complete search history.

(56) References Cited

U.S. PATENT DOCUMENTS 4,041,562 A * 8/1977 Nealy ..... B63B 35/7933 24/3.2
4,234,990 A * 11/1980 Colburn ..... B63B 35/7933 403/157
4,541,364 A * 9/1985 Contello ..... A01K 27/005 119/772
4,639,980 A * 2/1987 Peterson ..... A61M 25/02 128/DIG. 14
4,878,274 A * 11/1989 Patricy ..... A44B 18/00 24/306
4,958,758 A * 9/1990 Tipple ..... A45B 1/00 224/220
5,351,346 A * 10/1994 Hodges, Jr. ..... A47K 3/281 211/113
5,396,683 A * 3/1995 Ray ..... A01K 27/00 128/875
5,649,504 A * 7/1997 Culp ..... A01K 27/003 119/795
5,702,039 A * 12/1997 Olaiz ..... A63H 33/006 224/250
6,038,745 A * 3/2000 Rapp ..... A45F 3/14 24/165
6,694,575 B1 * 2/2004 Martin ..... A45F 5/02 206/315.3
7,343,647 B1 * 3/2008 Kinskey ..... A45F 5/00 16/406

(Continued)

*Primary Examiner* — Robert Sandy
*Assistant Examiner* — Louis A Mercado
(74) *Attorney, Agent, or Firm* — Mu P.C.

(57) ABSTRACT

A hand wear retention system has a cord having a first and second end, the cord for passing through sleeves of a garment, a first adjustable cord lock fastened to the first end, a second adjustable cord lock fastened to the second end, wherein the first and second ends protrude from the sleeves, positions of the first and second cord locks on the cord are adjustable and each of the first and second adjustable cord locks has a fastener for retaining hand wear. In another embodiment, the hand wear retention system has two anchors releasably mounted within the sleeves, each having a separate cord attached thereto, wherein the end of the cord has a cord lock which projects from the sleeve, wherein the cord lock has a fastener for engaging hand wear.

6 Claims, 7 Drawing Sheets

(56) References Cited

U.S. PATENT DOCUMENTS

| | | | | |
|---|---|---|---|---|
| 2004/0172735 | A1* | 9/2004 | Garland | A41D 19/0041 2/160 |
| 2005/0085350 | A1* | 4/2005 | Shen | A63B 23/00 482/91 |
| 2006/0143873 | A1* | 7/2006 | Stagnaro | A45F 5/00 24/3.3 |
| 2008/0313862 | A1* | 12/2008 | Brekke-Hutchings | A63H 33/006 24/3.13 |
| 2015/0096111 | A1* | 4/2015 | LeMarbe | F41H 1/02 2/336 |

* cited by examiner

HAND WEAR RETENTION SYSTEM

FIELD

The invention relates to hand wear retention systems, and particularly systems for retaining mittens and gloves in children's garments.

BACKGROUND

In winter, children need to wear hand wear such as mittens or gloves to keep their hands warm. However, when the mittens are not attached to the child somehow they are often lost as the child engages in play or otherwise. Further, if not associated with a garment like a jacket, they may be misplaced and not be available when required for going outdoors. Furthermore, some occupations in cold climates require the use of gloves or mittens, which must be removed and replaced frequently, and the gloves or mittens must be available for easy replacement. Constantly putting the gloves or mittens in pockets and searching for them again needlessly consumes time.

Some solutions have been proposed in the prior art, including strings or lanyards that are attached to the mitts and fed through the arms and across the back. Then, if a child takes off the mittens they may find them again near the location of the hands when their hands become cold. One problem with this solution is that the strings need to be tied or sewn to the gloves, making switching gloves as the temperature changes difficult. Also, the strings are of a fixed length and must be recreated when the child grows or tied up with a knot that may be caught up on the child's arms when jacket is put on or taken off. The strings are inelastic and do not give when pulled, as an elastic cord might, with the result of creating a strangulation hazard.

Many mitts and gloves have loops hanging at the side near the wrist area, and some ski jackets have hooks near the wrist to engage loops on mitts or gloves, so that when not in use the gloves hang from the sides of the jacket sleeves. Ski gloves normally extend beyond the wrist and are an appropriate length to engage with these hooks, however a fixed location for the hooks prevents shorter mitts from working.

Therefore there is a need for a system that allows the retention of mitts or gloves near the ends of the sleeves of a jacket that is useful for differing gloves and mitts, adjustable for length, and facilitates switching gloves or mitts.

SUMMARY

A hand wear retention system has a cord having a first and second end, the cord for passing through sleeves of a garment, a first adjustable cord lock fastened to the first end, a second adjustable cord lock fastened to the second end, wherein the first and second ends protrude from the sleeves, positions of the first and second cord locks on the cord are adjustable and each of the first and second adjustable cord locks has a fastener for retaining hand wear.

In an embodiment, the fastener is selected from the group consisting of a split ring, a garment clip, a spring clip and a snap hook. In an embodiment the cord locks are double locks, wherein the cord passing through the cord locks forms a loop and the fastener is mounted on the loop. The cord locks may be single locks and the fastener is mounted to the cord lock. The cord may be static or elastic.

In one embodiment, the cord has a breakaway point along its length, between the cord locks. It may have one or more channel guides affixed to the garment to contain the cord. The channel guides are affixed to the garment by adhesive or by stitching.

A hand wear retention system has a first cord connected to a first anchor affixed within a garment, the cord for passing through a first sleeve of the garment, wherein the first cord end protrudes from the first sleeve, a second cord connected to a second anchor affixed within the garment, the second cord for passing through a second sleeve of the garment, wherein the second cord end protrudes from the second sleeve, a first adjustable cord lock fastened to the first cord end, a second adjustable cord lock fastened to the second cord end, wherein the positions of the first and second cord locks on the cord are adjustable and each of the first and second adjustable cord locks has a fastener for retaining hand wear.

In one embodiment the first and second anchor are formed from a single piece of material, and in another, the anchors are formed of two separate pieces of material. The first and second anchors may be affixed to the garment by adhesive or stitching.

The fastener is selected from the group consisting of a split ring, a garment clip, a spring clip, spring hook and a snap hook. The cord locks may be double locks, wherein the cord passing through the cord locks forms a loop and the fastener is mounted on the loop, or single locks and the fastener is mounted to the cord lock. The first and second cords are elastic and may have a breakaway point. In an embodiment, the first and second anchors are affixed to the garment during manufacturing.

In a further embodiment, a hand wear retention system has one or more hand clips, each hand clip having a strap, a portion of hook and loop material affixed to a first end, and a hook affixed to a second end, the hook configured to retain a mitten wherein the hook and loop material is configured to be retained by the sleeve of a jacket. In an embodiment the strap passes through a portion of the hook to retain the hook. In a further embodiment the first end has a loop configured to engage with a hoop, and two or more hand clips are retained by the hoop.

DETAILED DESCRIPTION

Figure 1:
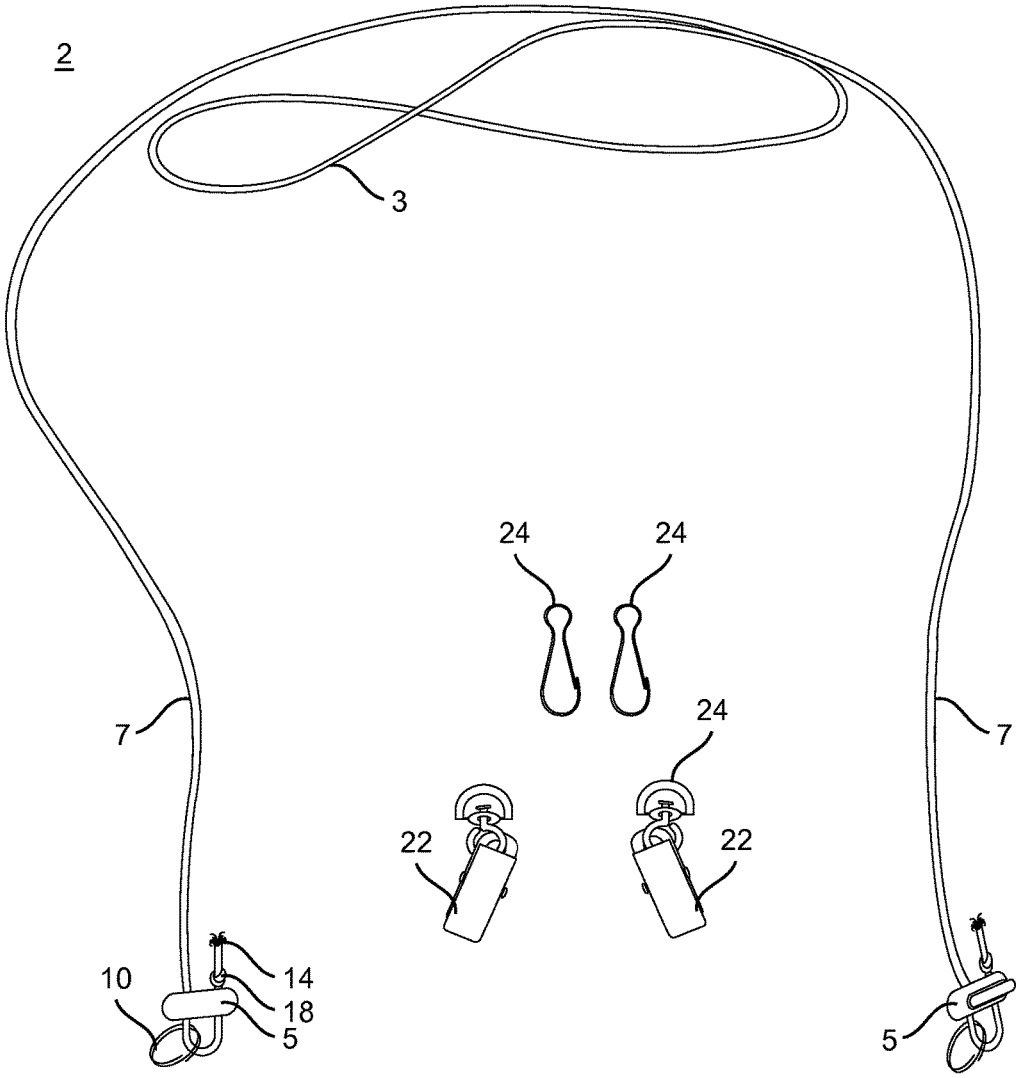
FIG. 1 shows an elevation view of the components of the hand wear retention system.

With reference to FIG. 1, a system 2 for the retention of hand wear such as gloves or mittens (referred throughout as simply "mittens") has a cord 3 terminated on each end with an adjustable cord lock 5. The cord locks 5 allow the effective length 7 (i.e. the length between the cord locks) of the cord 2 to be adjusted while maintaining the longest length in the cord 2 itself for adjustability. Effective length 7 of the cord 2 may be adjusted by garment or according to the size of the child, and may accommodate growth of the child.

Figure 2:
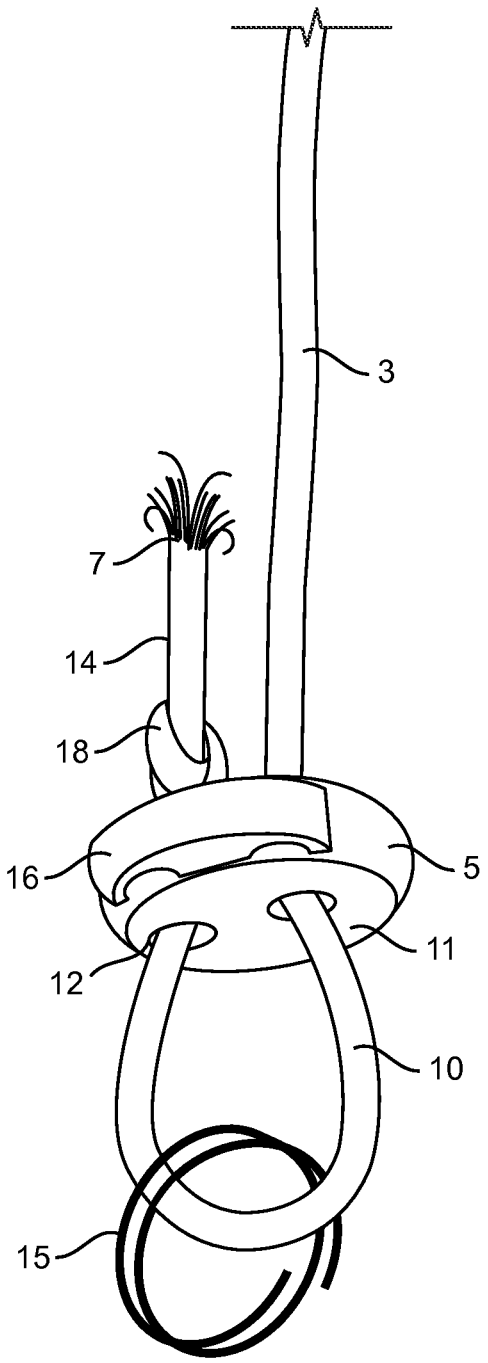
FIG. 2 shows a detail view of a cord lock.

With reference to FIG. 2, in one embodiment, each cord lock is a side-by-side double lock wherein the cord passing into a first aperture 11, forming a loop 10, and passing out of a second aperture 12 to produce an excess length 14. The first and second apertures 11, 12 are spring-biased to maintain force on the cord 3 passing through each aperture 11, 12, so the cord 3 is held and prevented from slipping through the apertures 11, 12. In one embodiment a single lock release button 16 pushes against the spring thereby opening or unbiasing the apertures 11, 12 and releasing pressure on the cord 3, so the position of the cord 3 within the cord lock 5 may be adjusted. This embodiment has the advantage of adjusting the loop 10 size. The loop 10 has a fastener 15 thereon, in the depicted embodiment a split ring, and the effective length is adjusted so the fastener or cord lock protrudes from the sleeve.

The excess length 14 may be tied with a knot 18 to prevent it from slipping back through the second aperture 12, or it may have a bead (not shown) thereon or other means of widening it to prevent the excess length from slipping through the second aperture 12. The excess length 14 beyond the knot 18 or bead (not shown) may be cut if not needed.

Figure 3:
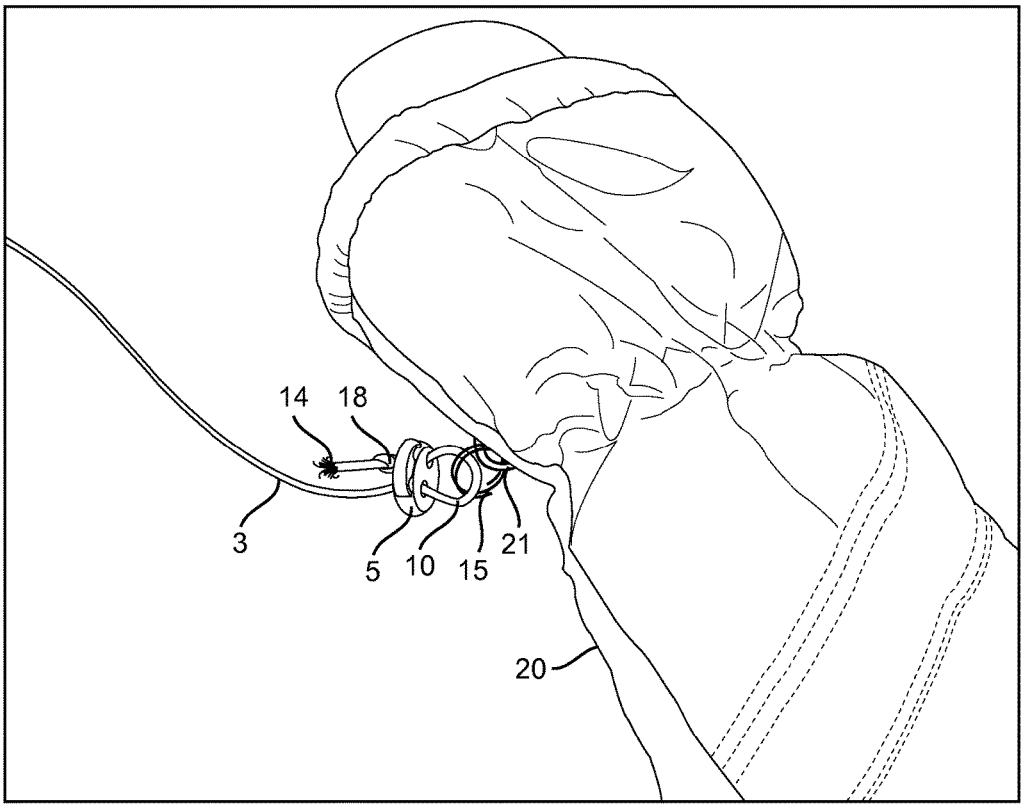
FIG. 3 shows a fastener on a loop engaging with a hook on a mitten.

With reference to FIGS. 1 and 3, in another embodiment, the cord lock 5 is a single cord lock (not shown), and has a fastener 15 for engagement with hook, ring or clip 21 affixed to the mitten 20. A further embodiment uses an over-under double lock (not shown) with a single lock release button.

With reference to FIGS. 1 and 3, in any configuration, the loop 10 formed by the cord passing through the first and second apertures 11, 12 holds a fastener 15 such as a split ring, which allows engagement with a hook, ring or clip 21 affixed to the mitten. In another embodiment, a garment clip 22 or alligator clip (not shown) hangs from the loop and enables clamping the mitten directly. Clips 22 are particularly advantageous where the mitten has no loop affixed thereon. In a further embodiment a snap hook 24 hangs from the loop in order to engage with a hook, ring or clip 21 on the mitten 20.

In one embodiment the cord 3 is elastic, which reduces strangulation hazard and prevents children pulling each other by the mittens. The cord 3 may be cut to a desired length once the cord locks 5 are positioned, or the excess length 14 may be maintained for future growth. The cord 3 may also be inelastic, allowing greater pressure to be put on a breakaway for more predictable breaking of the cord.

The cord 3 may also have a breakaway point (not shown) which releases on application of tensile force on the cord 3, wherein the tensile force is significantly less than that for which the cord is rated. This is to prevent injury, for example, where a cord 3 is tugged by another child, the breakaway will release, preventing the force from being exerted on the child wearing the system. Another common example is where a mitten is closed within a car door, while the child is out of the car. If the car were to depart, the breakaway would simply give way and release, leaving the child unharmed. The breakaway may be constructed of a releasable, replaceable clip, magnets or hook-and-loop fasteners, which release with a significantly lower tensile force than that withstandable by the cord before breaking. Other examples of breakaway construction include a snap, buckle, seat-belt style clips or suctions clips.

Figure 4:
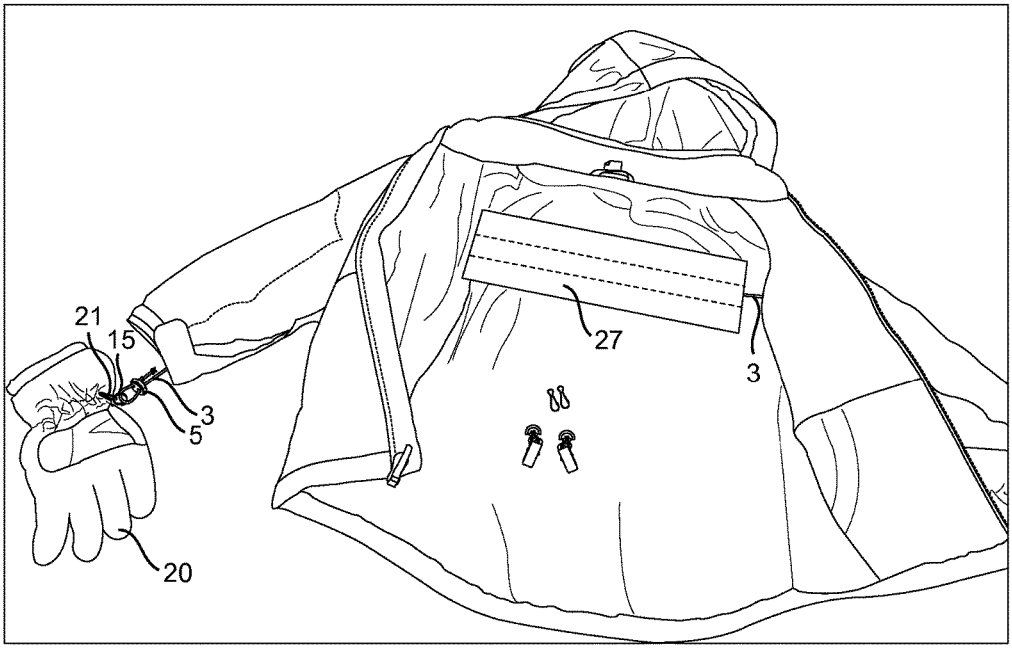
FIG. 4 shows the system positioned inside a garment.

With reference to FIGS. 1 and 4, before use, the cord 3 is fed through the sleeves of a garment 25, for example a coat or jacket, such that a cord lock 5 projects from each sleeve and the cord 3 connects the cord locks 5 by running across the inside back of the garment. The cord 3 is restrained across the inside back of the coat by a channel guide 27, which consists of a piece of fabric or flexible material, having adhesive or otherwise affixed to the garment on the top and bottom and a clear portion therein, to form a channel 28 along the length of the channel guide 27. The channel guide 27 is affixed to the inside back 29 of the garment 25 by the adhesive portions, and provides a channel 28 within which the cord freely moves. The channel guide 27 may be affixed by adhesive such as "iron-on" heat activated adhesive, or any number of fabric adhesives known in the art, or by mechanical fastener such as being sewn or clipped to the garment, for example. In one embodiment the channel guide is cut to the chosen size to fit a certain garment. In another embodiment, the channel guide 27 is made up of two or more pieces. In order to reduce the force on the channel guide 27 by the mittens and prevent its unintentional removal from the garment back 29, the channel guide 27 may be mounted below the sleeve holes. The channel guide 27 may be attached by the manufacturer to provide facility for mounting the system 2. In a three-in-one jacket having a liner, the channel guide(s) 27 are preferably mounted within the outer shell rather than the inner liner.

Figure 5:
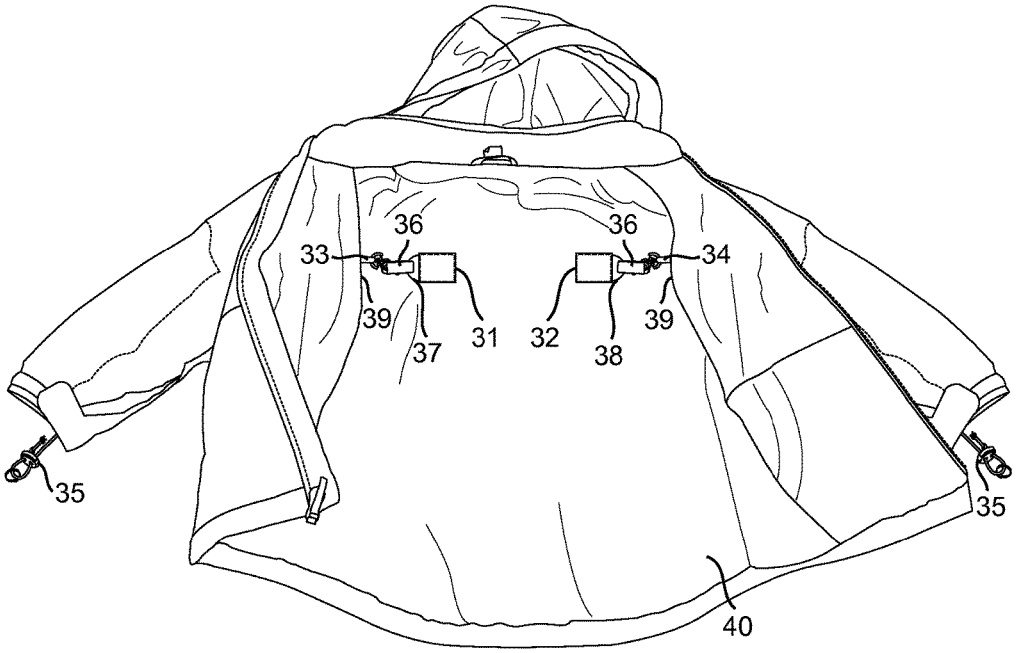
FIG. 5 shows the system having independent arm anchors.

With reference to FIG. 5, two anchors 31 and 32 hold the cord lengths 33, 34 of each respective side. The cord length of each side has a cord lock 35 at the end as described above. Each of the anchors 31, 32, is firmly affixed to the garment by adhesive or stitching. In one embodiment the cord length 33, 34 is affixed to its respective anchor by stitching or adhesive. In another embodiment each anchor has a cord loop 37, 38 sewn thereto, which loop extends into the sleeve 39 area of the garment 40. In another embodiment, the anchors 31, 32 have two parts, the anchor 31, 32 itself, affixed to the garment as described above, and a cord mount 31*a*, 32*a*, having the cord affixed thereto, the cord mount 31*a*, 32*a* removably attachable to the respective anchor 31, 32 by hook-and-loop fasteners, for example, such that the cords are removable when no needed in spring or fall, or for washing. The cord length 33, 34 is releasably attached to the cord loop with a clip or a breakaway 36, in an embodiment as described above. The anchors 31, 32 may be integrated into the garment by the manufacturer. The two anchor system has the advantage of avoiding tangling with the cord when a child put on or takes off the garment. In order to reduce the force on the anchors 31, 32 and prevent unintentional removal from the garment back 29, the anchors 31, 32 may be mounted below the sleeve holes 39. In a three-in-one jacket having a liner, the anchors 31, 32 are preferably mounted within the outer shell rather than the inner liner.

Figure 6:
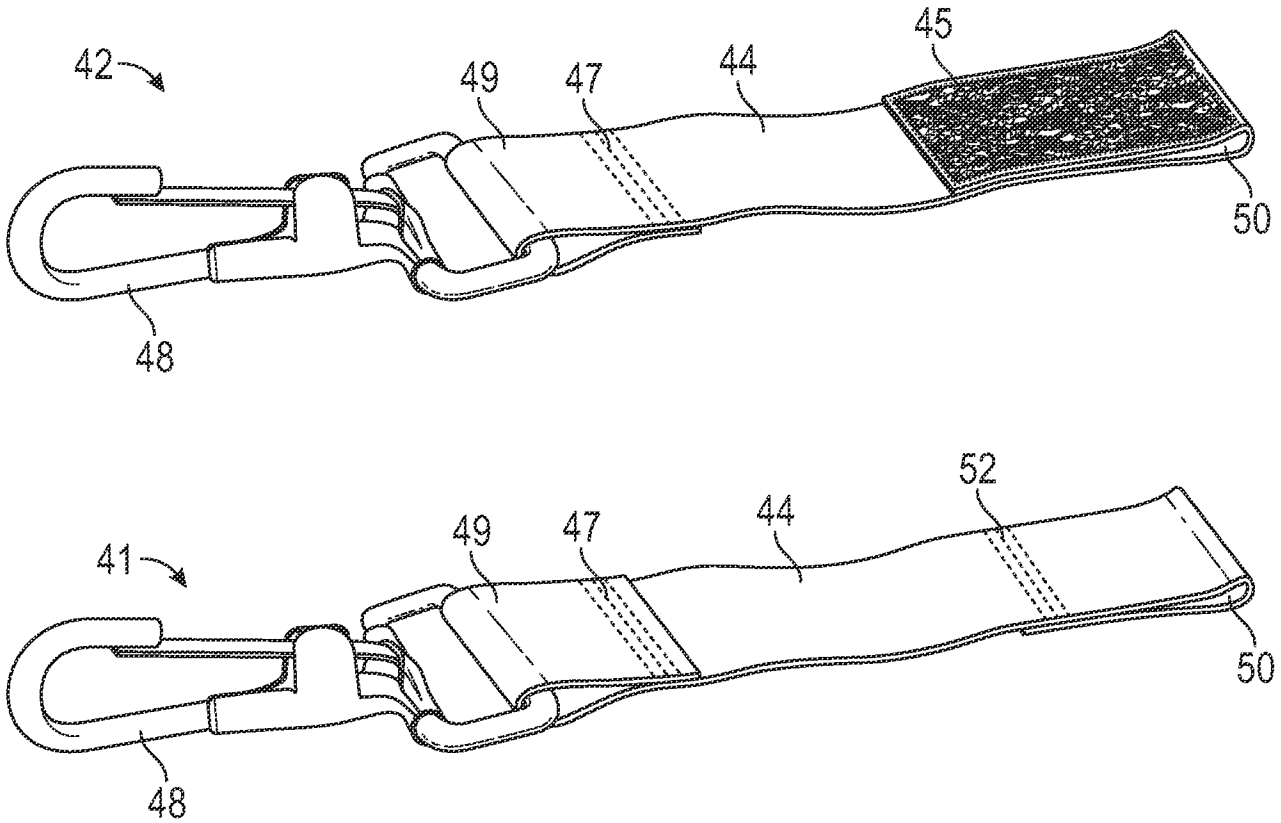
FIG. 6 shows an embodiment of the system having sleeve attachments.

With reference to FIG. 6, first and second embodiments of handwear clips 41, 42 are shown. Each handwear clip 41, 42 is a sleeve attachment having a strap 44 and having one surface 45 of a hook and loop fastener fastened thereto. The strap terminates in a spring hook 48, through which it passes. The strap 44 is then affixed to itself by a bar tack 47 or another joining means known in the art, holding the spring hook 48 therein, such that the spring hook 48 extends from the loop 49 of the strap 44. The spring hook 48 is configured to retain the hook, ring or clip 21 (not shown) affixed to the mitten or glove 20 (not shown). In an embodiment the strap 44 is also fixed on itself at the opposite end to that of the spring hook 48 with a second bar tack 52, to form a loop 50. In an embodiment, the circumference of the loop 50 is 2-3 cm to allow room for a carabiner 54 (see FIG. 7) or other metal or plastic hoop to be passed through the loop 50.

The surface 45 is configured to mate and removably retain a corresponding surface that is affixed, for example sewn or adhered, to the sleeve of a jacket. In one embodiment the surface 45 on the strap 44 is a hook surface for increased comfort of wearing a jacket. The handwear clips 41, 42 may be removably attached to the jacket by mating the hook and loop surfaces 45 with a corresponding piece on the jacket (not shown).

Figure 7:
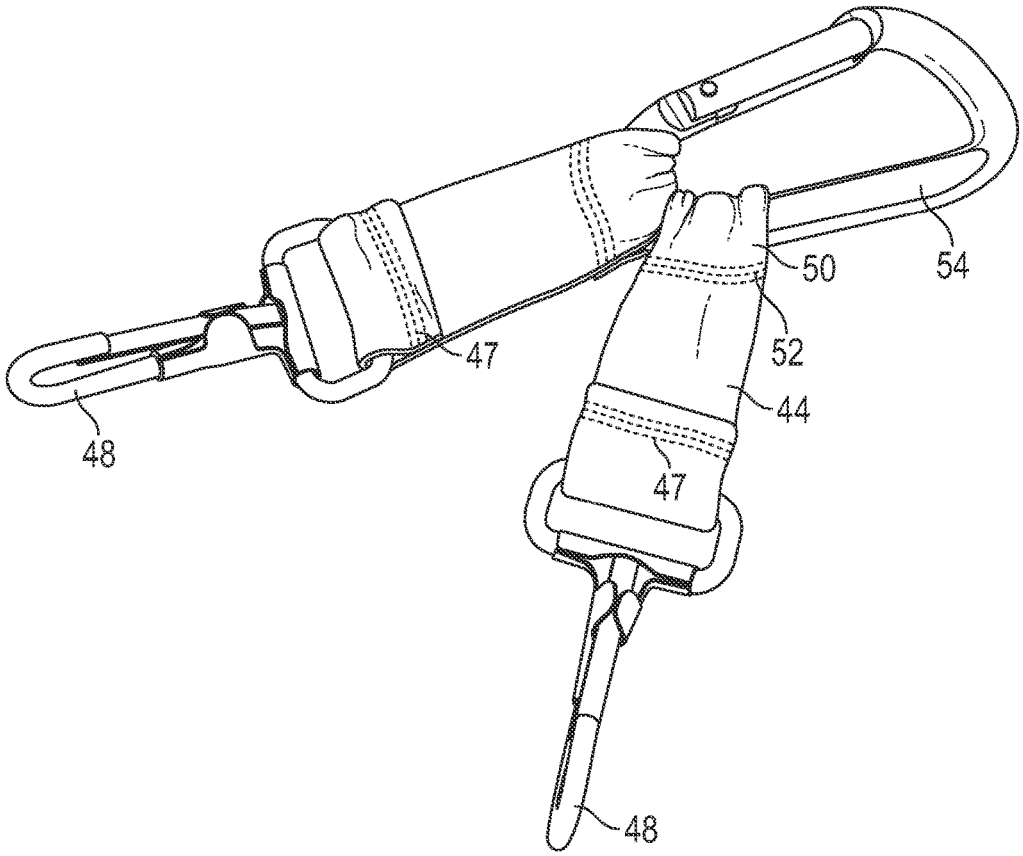
FIG. 7 shows a system for retaining spare mittens with sleeve attachments.

With reference to FIG. 7, a carabiner 54 or other metal or plastic hoop may be passed through the loop 50 to retain the handwear clips 41, 42 (with or without mittens attached), and may be connected to a backpack or hung on a hook in a locker, for example, for storing spare sets of mittens. When needed, the carabiner 54 may be removed and the handwear clips 41, 42 can be separated from one another and attached to the sleeves of a jacket by the hook and loop surface 54. The handwear then dangles beside the sleeves until it is put on by the user.

This clip as depicted in FIGS. 6 and 7 has multiple functionalities for a wide variety of settings including, but not limited to, sports, school, and recreation for all ages. It can be attached to the handles or straps of various types of bags, for example a backpack or tote. It is configured to be clipped onto the outside or inside of a bag. Further, it is configured to hold anything that doesn't fit inside of the bag or that a user doesn't want to be in the bag for any reason, for example because the item is wet or dirty.

I claim:

1. A handwear clip consisting of:

a. a strap having:

i. a middle portion;

ii. a first loop formed by folding a first end of the strap and affixing it to the middle portion via a first bar tack; and iii. a second loop formed by folding a second end of the strap and affixing to the middle portion via a second bar tack, an outside surface of the second loop consists of a first surface of a hook and loop fastening system;

b. a d-ring disposed within the first loop; and c. a spring hook hingedly attached to the d-ring.

2. The handwear clip of claim 1, wherein the first and second bar tacks are provided on opposite sides of the strap.

3. The handwear clip of claim 1, wherein the spring hook is configured to engage an article of handwear while being hingedly attached to the ring.

4. A handwear clip comprising:

a. a strap having:

i. a middle portion;

ii. a first loop formed by folding a first end of the strap and affixing it to the middle portion via a first bar tack; and iii. a second loop formed by folding a second end of the strap and affixing to the middle portion via a second bar tack, an outside surface of the second loop comprising a first surface of a hook and loop fastening system;

b. a ring disposed within the first loop; and c. a spring hook hingedly attached to the ring.

5. The handwear clip of claim 4, wherein the first and second bar tacks are provided on opposite sides of the strap.

6. The handwear clip of claim 4, wherein the spring hook is configured to engage an article of handwear while being hingedly attached to the ring.

* * * * *